United States Patent [19]

Darby

[11] Patent Number: 4,842,276

[45] Date of Patent: Jun. 27, 1989

[54] GAME DEVICE FOR RANDOMLY SELECTING PLAYERS

[76] Inventor: Christian Darby, 224 Sullivan #23C, New York, N.Y. 10012

[21] Appl. No.: 70,432

[22] Filed: Jul. 7, 1987

[51] Int. Cl.[4] ..... A63B 71/04

[52] U.S. Cl. ..... 273/1 E; 273/1 GC; 434/336; 434/352

[58] Field of Search ..... 273/1 E, 1 G, 1 C, 1 GE, 273/85 G, DIG. 28; 434/336, 350-352

[56] References Cited

U.S. PATENT DOCUMENTS 4,004,354 1/1977 Yamauchi ..... 434/336
4,051,605 10/1977 Toal et al. ..... 35/30
4,207,087 6/1980 Morrison et al. ..... 237/1 E
4,285,517 8/1981 Morrison ..... 273/1 GC
4,363,482 12/1982 Goldfarb ..... 273/1 GC
4,372,554 2/1983 Orenstein ..... 273/1 E

*Primary Examiner*—Maryann Lastova
*Attorney, Agent, or Firm*—George W. Neuner

[57] ABSTRACT

An electronic game device for randomly selecting the player or players to participate in each round of a game. The device preferably has a control module, a plurality of output stations, one output station associated with each player. When the device is initiated, a controller randomly provides a signal to one or more selected output stations to indicate that the player associated with a selected station has been selected to participate in that round of the game.

14 Claims, 2 Drawing Sheets

GAME DEVICE FOR RANDOMLY SELECTING PLAYERS

FIELD OF THE INVENTION

This invention relates to electronic games and, in particular, to electronic devices that aid in playing parlor games wherein one or more selected players must respond to a stimuli requiring a preselected response, preferably within a period of time.

BACKGROUND OF THE INVENTION

Many previous electronic games have generally required the user(s) or player(s) to respond by manipulating one or more switch handles or buttons. In the now-familiar electronic football or baseball games, for example, the switches often control the apparent position, attitude, or simulated thrust of a moving spot or shape that represents the player. The spot may be an illuminated lamp or grouping of lamps or, in the slightly related field of video-computer games, the spot may be an elaborately shaped figure formed by the video screen technology. Another remote relative is the programmed learning device or question-and-answer game in which the student or player manipulates levers, buttons, or a keyboard to answer questions.

In U.S. Pat. No. 4,363,482, an electronic game is described for playing a certain traditional parlor game which turn saying one number in the normal numerical sequence (i.e., "one, two, three, . . . ")—but with certain numbers replaced by a distinctive word or other prearranged sound. For example, such a word or sound replaces all numbers that either (1) have a certain numeral as one digit or (2) are multiples of that numeral. The numeral chosen for use in the game may be called the "base numeral." If the base numeral is nine, for instance, the distinctive word or sound replaces the numbers 9, 18, 19, 27, 29, 36, 39, and so on; if the prearranged word is "alligator" the correct sequence would include this segment " . . . sixteen, seventeen, alligator, alligator, twenty, twenty-one, . . . " A player errs when his turn arrives if he should say, for instance, "seventeen" but instead says "alligator"; or if he should say "alligator" but instead says "eighteen" or "nineteen"; or if he becomes confused and is unable to make any response in the rhythm of the counting. Depending on the form of the game, either (1) a player who errs in any of these three ways may be expelled from the game, so that the number of active players decreases until only a winner remains (or some arbitrary count is reached at which all remaining players are winners); or (2) the sequence is continued with all the players remaining active, any errors giving rise only to amusement.

The device consists of circuitry responsive to a microphone which generates a definite electrical signal when any adequately loud sound is received—always the same signal, regardless of the intelligence content of the sound. Thus the counting aloud serves only to inform the electronic unit that the count is advanced and the unit itself keeps track of what number each count should represent, without discriminating between the sounds.

The apparatus advantageously defines a plurality of players stations, each of which has an associated lamp or other visual device for indicating when the turn passes to that particular station—i.e. for prompting or interrogating the player at that station. The device may also emit a sound at the same time as it produces the visual interrogation signal.

However, the above described game is limited to only small variations in the manner of play. It would be desirable to have a simple electronic game that would aid in playing a parlor game that could be played in an endless number of variations, governed by the imagination of the players.

SUMMARY OF THE INVENTION

The present invention provides an electronic game device comprising a control module, a plurality of output stations to provide signals to players, start means to initiate the device, and control means responsive to the start means for randomly providing a signal to one or more selected output stations to elicit a response from the player associated with a selected station.

In one embodiment of the invention, the electronic game device comprises a central module having the start means and control means. The output stations each comprise a player module that is connected to the central module by a detachable communication means such as a wire or cable. The player modules each comprise an indicator means which provide a signal to the respective player. The signal can be visual, auditory or a combination of both.

In one preferred embodiment of the invention, upon initiating the start means, the control means determines the number of players participating in the game by determining the number of active output stations and provides a signal to each of the active output stations to indicate that each is working. After a brief time delay, one or more, preferably two or more of the active stations selected at random are provided with a signal to elicit a response from the player at the selected station(s). The player at a selected station who responds first is the winner of the round. The control means can preferably also provide a signal at the end of a predetermined time period during which a response can be made, thereby terminating that particular round even though a response has not been made by one of the selected players.

There may also be a display panel which can be an attachment or part of the control module. The display can be used to keep score, to show the task to be performed, etc.

The game is initiated by a control on the central module. All of the player modules indicate that they are functioning and part of the system by giving a visual or audible signal, preferably, visual. After each player module has acknowledged that it is functioning, the central module will randomly select one or more of the player modules by providing a visual or audible signal to the selected modules. The players at the selected modules will then be required to perform a task, preferably in a predetermined time. If more than one player module is selected, the performance is competitive with the first player to perform his task winning. Typically two player modules are selected for each round, however, more than two can be selected. This completes one cycle or round. A new cycle can be started by initiating the control module.

Any of a wide variety of tasks can be set up to be performed by the selected players. For instance, the player may be required to identify something specific from a predetermined category. Each player may have a different predetermined category, e.g. Musicals, Broadway Plays, Dramas, Motion Pictures, etc. or each player can have the same category. Various categories can be programmed into the display, if used, and the categories can be selected randomly for each cycle. The game can also be used as a teaching tool with one or more players responding to the displayed message or category.

DETAILED DESCRIPTION OF THE PREFERRED EMBODIMENTS

Figure 1:
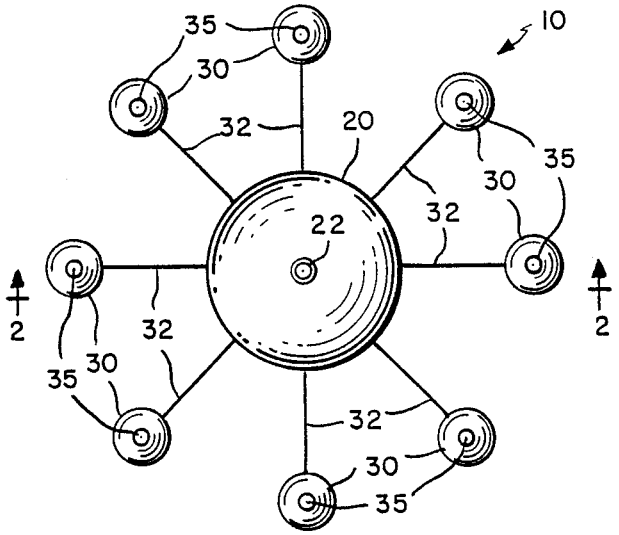
FIG. 1 is a plan view of one embodiment of the invention having a central module with eight player modules attached thereto.
Figure 2:
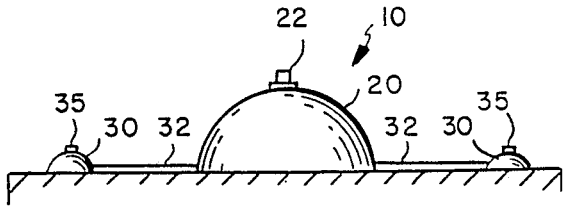
FIG. 2 is an elevational view of the device of FIG. 1 along line 2—2.

Referring to the drawings, FIG. 1 illustrates one embodiment of an electronic game device 10 in accord with the present invention. Device 10 comprises a central housing 20 which can be provided in any shape, here advantageously shown as a dome. Housing 20 has a power switch (not shown) and a momentary contact switch 22 for initiating the game. The housing 20 also contains a power supply, for example, in the formed of a battery or an electrical word for connecting to an ac wall outlet, and contains the electronic control circuits for the game.

Figure 4:
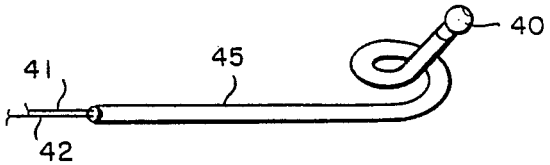
FIG. 4 is a side view of alternative embodiment for a player station comprising a partially flexible tube with a light bulb at one end.

Player stations or modules 30, each having a lamp 35 or other light emitting means, such as a light emitting diode (LED) are connected to the central housing via detachable electrical cables 32 which attach to the housing by a conventional plug/receptacle arrangement (not shown). In an alternative embodiment, as illustrated in FIG. 4, a player station is shown as a lamp 40 attached to the end of a partially flexible tube 45, such as a thin-walled aluminum tube, which may be bent by the player to position it as desired. Electrical wires 41, 42 are located within the tube to carry power to the lamp 40 and the tube is connected to the central housing by suitable means (not shown) readily provided by the skilled mechanic.

Game devices in accord with the present invention ca comprise any number of player stations. Preferably, about four to eight player stations are used for convenience. However, the number of player stations is not limited, except by practical consideration regarding how many players can participate in any particular game, which depends upon the particular game being played.

In one preferred embodiment, the control means comprises an electronic circuit that randomly selects two player stations at which the corresponding players competitively respond in a pre-arranged manner.

Figure 3:
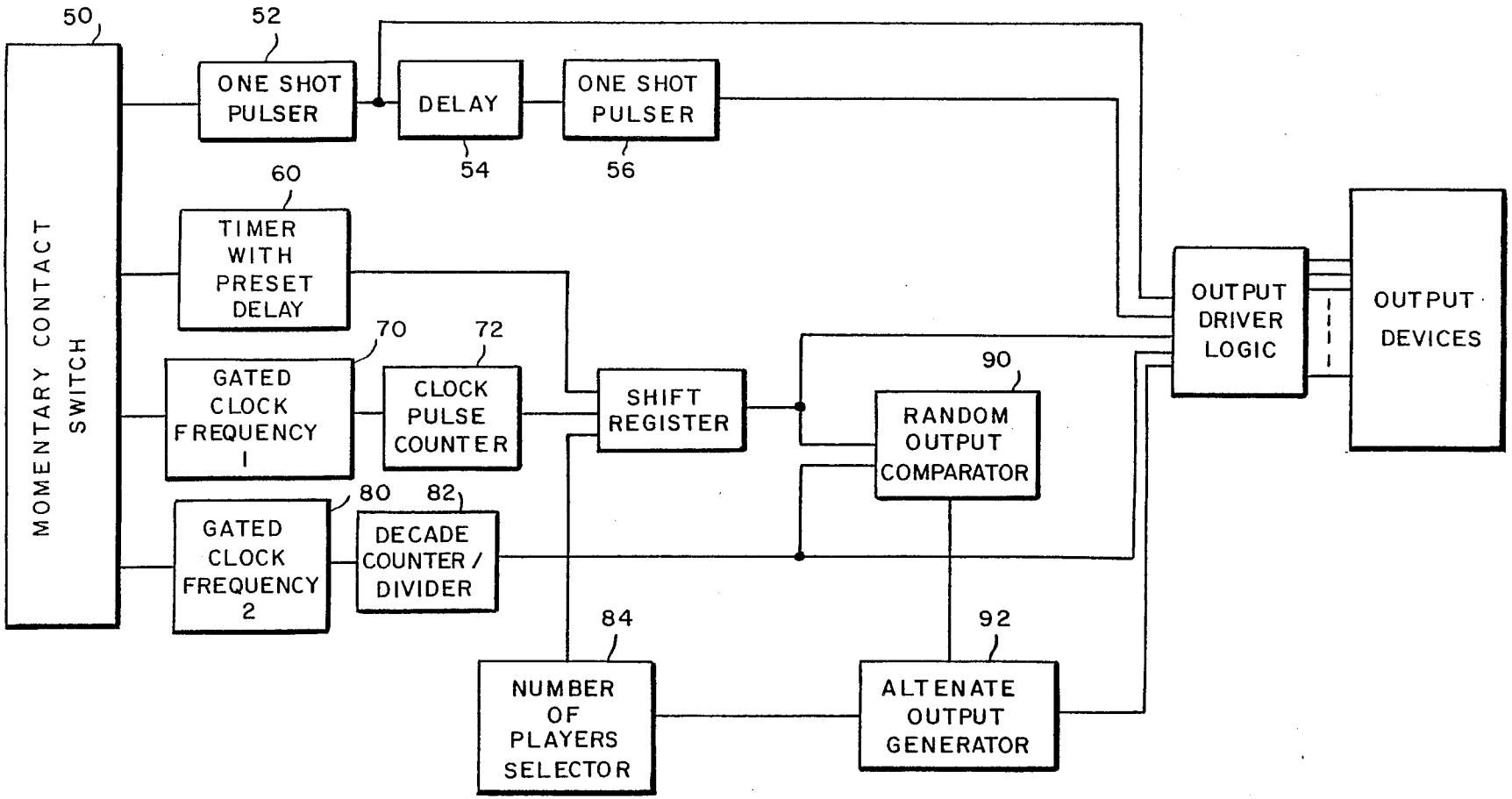
FIG. 3 is a block diagram of the electronic circuit used within the embodiment illustrated in FIGS. 1 and 2.

With reference to FIG. 3, the electronic circuit will be described. Momentary contact switch 50 is depressed to initiate one cycle or round of the game. Upon contact a single pulse of current is generated which causes the LED at each connected player station to flash on and off to indicate it is activated. Following the single pulse, a delay circuit 54 is activated which generates a second pulse 56 that again causes the LED at each connected player station to flash on and off.

Simultaneously, with the pulsing, a timer circuit 60 is initiated with the contact switch 50. A 555 timer chip with suitable capacitor and resistor for the desired time period is used to determine when two randomly chosen LED's will turn on and remain on to identify the players who are required to perform according to the game.

The contact switch also initiates two gated clocks 70, 80. Clock 70 has a frequency $F_1$, on the order of $10^4$ Hz. The number of clock pulses generated (modula $8+1$) while the switch is in the "on" position (i.e. in contact) is stored in any array of eight (8) flip flops 72. The stored number of pulses is used to clock a bank of registers which can have one high output. The register driven high is determined by the number of active player stations 84 and the number of clock pulses stored in the flip flops.

Clock 80 has a frequency $F_2$ which is also on the order of $10^4$ Hz but is not equal to $F_1$. This signal is used to clock an 8 digit counter 82. The output line of the counter driven high is determined by how many clock pulses are generated while the switch is in the "on" position and by the number of active player stations 84.

The output line selected by clock pulse counter 72 is compared to the output line selected by counter 82 by a random outputs comparator 90. If the two output lines selected are different, the LED's on the player stations corresponding to the selected output lines are lighted. If the two selected output lines are the same, then an alternate output generator 92 is triggered which energizes two LED's by stepping through a list of ordered pairs of LED's corresponding to every combination of active player stations.

The LED's of the two selected stations remain "on" until the players have performed in accord with the game and the contact switch 50 is depressed again to initiate a new cycle or round of the game.

One method of playing a game using a device in accord with the invention requires each player to choose a category from a list or as suggested by other players. Categories must be agreed upon by all players so that each player knows the categories being selected by the other players. Examples of categories that can be chosen include:

| | |
|---|---|
| ACTORS | BAKED GOODS |
| ACTRESSES | BARS |
| AIRLINES | BASKETBALL PLAYERS |
| AMERICAN POP GROUPS | BEACHES |
| ANATOMY | BEERS |
| ANIMALS AT THE ZOO | BEVERAGES |
| APPLIANCES | DEPARTMENT STORES |
| ARTISTS | DESIGNERS |
| ATHLETIC EQUIPMENT | DESSERTS |
| AUTHORS | DOGS |
| AUTOMOTIVE PARTS | EUROPEAN CITIES |
| BIBLICAL CHARACTERS | FAST FOODS |
| BIRDS | FISH |
| BOOKS | FLOWERS |
| BRITISH ROCK GROUPS | FOOTBALL PLAYERS |
| BROADWAY PLAYS | FORTUNE 500 COMPANIES |
| BUILDINGS | FRAGRANCES |
| CANDY | FURNITURE |
| CAPITALS | HATS |
| CARS | HEALTH FOODS |
| CARTOON CHARACTERS | HOBBIES |
| CATALOGUES | HOLIDAYS |
| CEREALS | ICE CREAM FLAVORS |
| COCKTAILS | ISLANDS |
| COLLEGES | JOBS |
| COLORS | LAKES |
| COMEDIANS | LIQUORS |
| COUNTRIES | MAGAZINES |

-continued

| | |
|---|---|
| COUNTRY MUSIC | MATERIALS |
| STARS | METHODS OF |
| CURRENCIES | TRANSPORTATION |
| MONUMENTS | STONES |
| MOVIES | SUMMER SPORTS |
| MOUNTAINS | TEAM MASCOTTS |
| MUSEUMS | TELEVISION GAME SHOWS |
| MUSICAL INSTRUMENTS | T.V. SHOWS |
| NEWS CASTERS | TOOLS |
| NEWSPAPERS | TOYS |
| PARKS | TREES |
| PETS | UNIVERSITIES |
| POP SINGERS | WARS |
| PRESIDENTS | WINTER SPORTS |
| PRODUCE | WORDS STARTING WITH "Z" |
| PROFESSIONAL TENNIS | WORLD LEADERS |
| PLAYERS | |
| RECORDS | |
| RESORT AREAS | |
| RESTAURANTS | |
| RIVERS | |
| ROYALTY | |
| SHAMPOOS | |
| SHOES | |
| SOAP OPERA STARS | |
| SOCCER PLAYERS | |
| SPORT TEAMS | |
| STATES | |
| STREETS | |

To play, the device 10 is placed in the center of the players with the power switch on. Each player plugs in a player station 30 and places it in front of him, enabling all players to see it.

Any player may start the game by depressing switch 22 on housing 20. All lights or LED's 35 will illuminate twice to insure that the stations are functioning. (If one does not light up twice, replace it with another station.) Thereafter, at random, just two lights will illuminate, prompting each player with an illuminated light (a selected player) to name something in the opposing player's category before (s)he does the same. For example: if the light for player A (Ice Cream Flavors) simultaneously illuminates with the light for player B (Sports), player A needs to name a "Sport" (Football, Baseball, Soccer, etc.) before player B names an "Ice Cream Flavor" (Vanilla, Rocky Road, Peach, etc.).

Players not participating in the showdown (or round) act as judges as to who answers correctly first. The "winner" of each showdown receives one point for each "win" and starts the next round by depressing the switch 22. Players keep their own scores. Answers can not be repeated during the same game.

Players must earn a predetermined number of points, e.g. fifteen, to win the game, but the number may vary depending on players.

The game device can also be used in another manner with small children or as a teaching aid. A parent or teacher and players may decide on one category for the group. When selected indicators illuminate, the first child to name something in that category wins that round. Keeping score is not essential, and usually not necessary.

The parent or teacher may elect to use a category such as "Things That Are Dangerous In The House," and when a child responds (stove, for example), the round will stop and players will discuss when that item is dangerous.

Devices in accord with the invention can be used in a wide variety of ways to play parlor games or to aid in education. The devices can be modified to set the environment for particular types of games. For instance, the housing may be shaped like a house, school, animal, globe, etc.

Also the device itself can be modified to be programmable, to define a particular or variable time period for response to the player station stimuli, etc. A display may be added to the device to keep score and/or to display a category to which the selected players respond, etc.

Upon consideration of this disclosure, many other variations within the spirit and scope of this invention will be envisioned by those skilled in the art. Thus, it is not intended that the invention be limited by the specific embodiments disclosed but only by the scope of the appended claims.

I claim:

1. An electronic game device for randomly selecting the player or players to participate in each round of a preselected game, said device comprising a control module, a plurality of output stations, one output station associated with each player playing the game device, each output station having signal means for emitting a sensory signal to the player associated therewith, start means to initiate the device and control means, responsive to the start means having means for randomly determining the player or players to participate in a round and for generating and substantially simultaneously transmitting a signal to two or more selected output stations to indicate that the players associated with the selected stations have been selected to participate in that round of the game.

2. The game device of claim 1 wherein the output stations are located on the control module.

3. The game device of claim 1 wherein the output stations are connected to the control module.

4. The game device of claim 1 wherein the number of output stations is from 3 to 8.

5. The game device of claim 1 wherein the control means comprises means for providing a signal at the end of a predetermined time period during which a player can provide a response.

6. The game device of claim 1, further comprising a display device.

7. The game device of claim 1 wherein the signal is visual.

8. The game device of claim 1 wherein the signal is audial.

9. The game device of claim 1, further comprising means for programming the number of players or the time period for response.

10. The game device of claim 1, further comprising display means for visually displaying information associated with a game and means for programming the device to display various information associated with the game.

11. An electronic game device comprising power supply means, eight player stations, each player station having signal means for emitting a sensory signal to a player, start means for initiating a playing cycle and a control means responsive to the start means, having means for randomly determing the player or players to participate in a playing cycle and for substantially simultaneously providing a signal to two or more selected player stations to indicate that the players associated with the selected stations have been selected to participate in that playing cycle.

12. The game device of claim 11 wherein the signal means comprises an LED.

13. The game device of claim 12 wherein the LED of each selected station is lighted for a predetermined period during which a response can be given.

14. The game device of claim 13, further comprising display means for displaying information associated with the game.

* * * * *